US006550175B2

(12) United States Patent
Parker

(10) Patent No.: US 6,550,175 B2
(45) Date of Patent: Apr. 22, 2003

(54) USER FRIENDLY GUNLOCK

(76) Inventor: Peter Mario Parker, 314 6th Ave., Baraboo, WI (US) 53913

( * ) Notice: Subject to any disclaimer, the term of this patent is extended or adjusted under 35 U.S.C. 154(b) by 0 days.

(21) Appl. No.: 09/858,040

(22) Filed: May 16, 2001

(65) Prior Publication Data

US 2002/0014030 A1 Feb. 7, 2002

Related U.S. Application Data

(60) Provisional application No. 60/223,612, filed on Aug. 7, 2000, provisional application No. 60/224,789, filed on Aug. 14, 2000, and provisional application No. 60/226,315, filed on Aug. 21, 2000.

(51) Int. Cl.[7] ..... F41A 17/00
(52) U.S. Cl. ..... 42/70.07
(58) Field of Search ..... 42/70.07, 70.11

(56) References Cited

U.S. PATENT DOCUMENTS

| | | | | | |
|---|---|---|---|---|---|
| 965,386 | A | * | 7/1910 | Hansen | 42/69.03 |
| 2,598,924 | A | * | 6/1952 | Lind | 42/70.06 |
| 2,657,490 | A | * | 11/1953 | Browning | 42/66 |
| 3,352,047 | A | * | 11/1967 | McDonnell | 42/70.01 |
| 4,030,221 | A | * | 6/1977 | Doobenen et al. | 42/70.07 |
| 4,995,180 | A | * | 2/1991 | Tucker et al. | 42/70.07 |
| 5,544,440 | A | * | 8/1996 | Stockman | 42/70.06 |
| 5,678,342 | A | * | 10/1997 | Felk | 42/69.02 |
| 5,720,193 | A | * | 2/1998 | Dick | 211/64 |
| 5,778,586 | A | * | 7/1998 | Carlson | 42/70.07 |
| 5,927,578 | A | * | 7/1999 | Kay | 224/244 |
| 6,009,654 | A | * | 1/2000 | Williams et al. | 206/317 |
| 6,301,816 | B1 | * | 10/2001 | Saltz | 42/70.01 |
| 6,389,726 | B1 | * | 5/2002 | Bentley | 42/70.06 |

FOREIGN PATENT DOCUMENTS

| | | | | |
|---|---|---|---|---|
| FR | 1134406 A1 | * | 5/1955 | 42/70.07 |

* cited by examiner

*Primary Examiner*—Michael J. Carone
*Assistant Examiner*—Denise J. Buckley
(74) *Attorney, Agent, or Firm*—Joseph T. Leone, Esq.; DeWitt Ross & Stevens S.C.

(57) ABSTRACT

A gunlock that is semi-permanently attached to the trigger guard of a firearm. The gunlock is designed to stay attached to the trigger guard both when the firearm is locked and unlocked. A trigger jam simply moves into a locked position where it locks the trigger in a rearward or forward position. Once the correct combination has been entered via thumb-wheels, a push-button quickly releases the jam. If complete removal of the gunlock is desire able, a second push on the push-button completely release the gunlock. An alternative design of this gunlock incorporates the lock as an integral part of the trigger guard. Its compact streamline design provides an attractive appearance.

9 Claims, 9 Drawing Sheets

FIG. 1
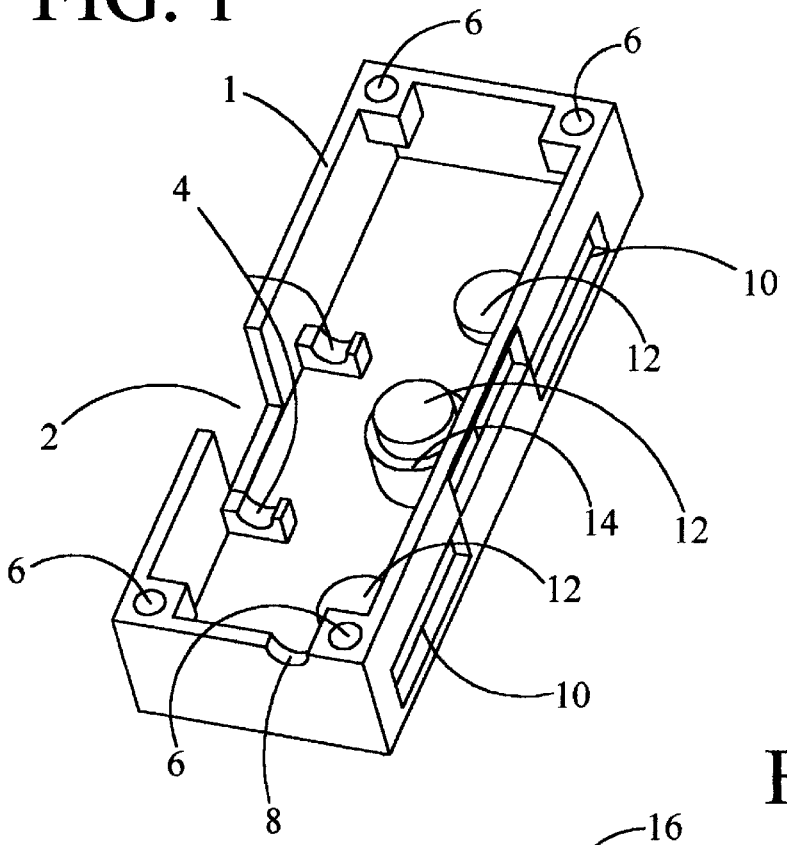
FIG. 2
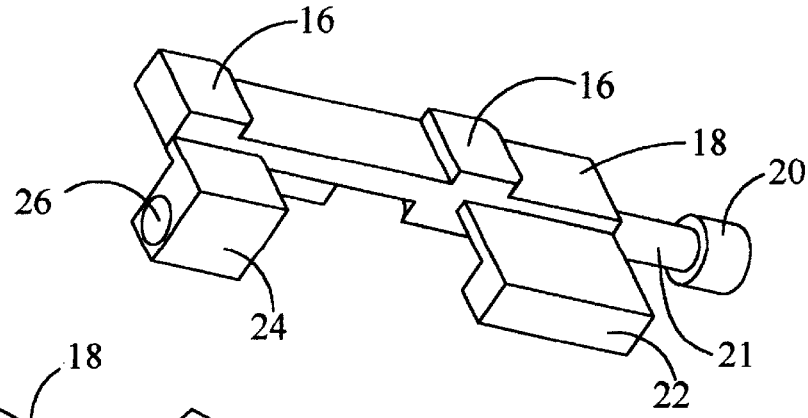
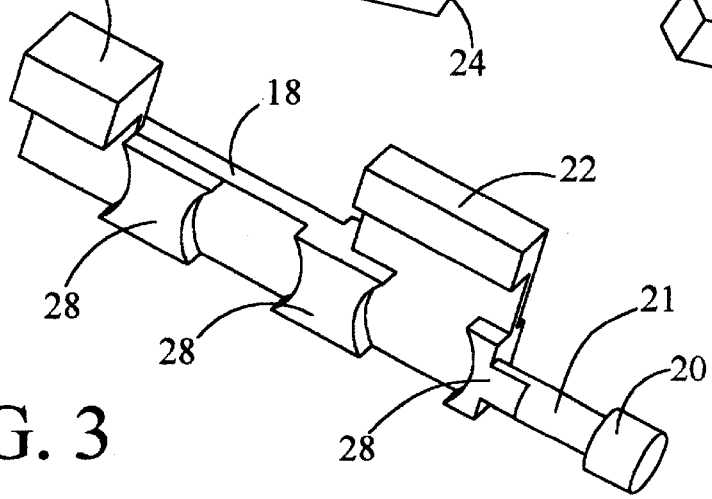
FIG. 3

USER FRIENDLY GUNLOCK

CROSS-REFERENCE TO RELATED APPLICATIONS

This application claims priority under 35 USC §119(e) to U.S. provisional patent applications Ser. Nos. 60/223,612, filed Aug. 7, 2000; 60/224,789, filed Aug. 14, 2000; and 60/226,315, filed Aug. 21, 2000, all three of which are incorporated herein by reference.

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

Gunlocks are an important tool to safeguard against accidental firearm discharges that may result in injury or death. Although there are many types of gun locks on the market today, there are still many people who do not lock up their firearms and many who reluctantly use what is available on the market. One reason people do not lock up their firearms or are unhappy with what is available is a matter of practicality. Many gunlocks are cumbersome to use and take away from the attractive appearance of their firearms. Others are time consuming to disengage which raises concern when home security is an issue. Many require the use of keys, and after forgetting your keys at home while on a hunting trip, firearm users become reluctant to make the same mistake twice and stop using gunlocks altogether.

The User Friendly Gunlock is practical, easy to use, disengages quickly and does not require keys. This gunlock looks attractive on firearms and can be incorporated into newly manufactured firearms, and the simple design keeps cost down.

BRIEF SUMMARY OF THE INVENTION

The object of the present invention is to provide a gun lock that retrofits existing trigger guards as well as to provide a gun lock that can be incorporated as an integral part of newly manufactured guns.

The User Friendly Gunlock comprises a lock that is attached to trigger guard via an adapter where the adapter is designed to adapt the lock to a specific model or models of handgun trigger guards. The lock is designed to stay attached to the trigger guard both when the gunlock is in the locked position and when the gunlock is in the unlocked position. Fastening clamps from the adapter embrace and fasten the device onto existing trigger guards. Once attached, a trigger jam cam be moved into a position adjacent the trigger to lock the trigger in a rearward or forward position. Once the correct combination has been set via thumb-wheels, a button can be pushed to release the trigger jam and return the trigger jam to a rest position. Having returned the trigger jam to the rest position, another push of the button while the combination is still set unlatches the fastening clamps so the gunlock may be removed from the trigger guard if the owner of the gun wishes.

An alternative design of the gunlock incorporates the gunlock as an integral part of the trigger guard. To lock the gun, the user pushes a button forward until a cam moves into position adjacent the trigger, locking the trigger in a forward or rearward position. When the combination is entered via thumb-wheels, another button may be pushed forward, returning the cam to a rest position.

BRIEF DESCRIPTION OF THE SEVERAL VIEWS OF THE DRAWING

FIG. 1 is perspective view of the housing.

FIG. 2 is perspective view of the keyed cylinder.

FIG. 3 is another perspective view of the keyed cylinder.

DETAILED DESCRIPTION OF THE INVENTION

Figure 4:
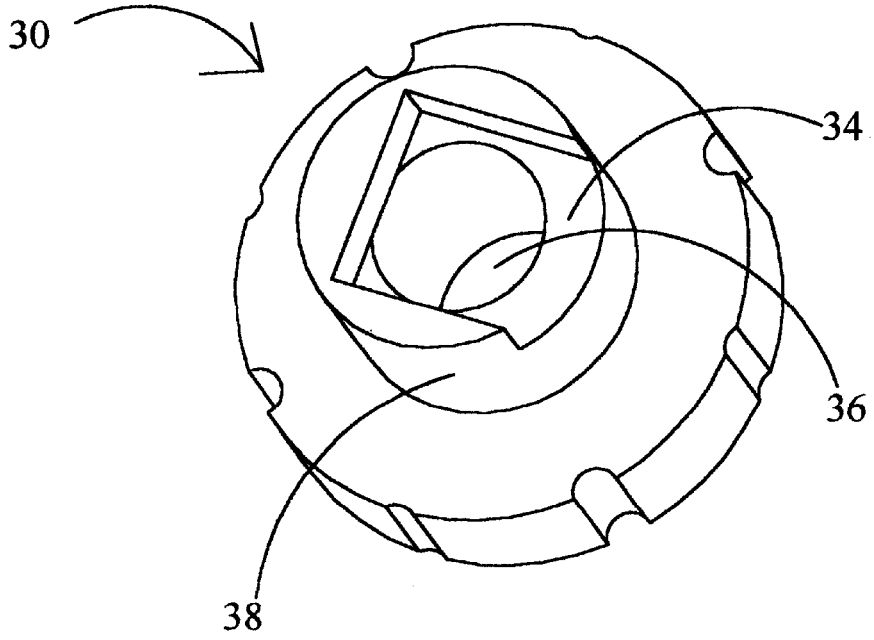
FIG. 4 is a perspective view of the end thumb-wheel.

Referring to FIG. 1. The housing 1 is surrounded by side walls and a base, and has mounting means 6 as shown. A notch 8 is located near the upper edge of a side wall. Thumb-wheel windows 10 are located on one side wall as shown. A trigger jam window is located on one side wall as shown. Jam supports 4 are located on either side of the trigger jam window 2. Thumb-wheel pins 12 extend upwards from the base. Pedestal 14 elevates one thumb-wheel pin 12 higher than the other thumb wheel pins 12 as shown.

Referring now to FIGS. 2 and 3. A keyed cylinder 18 has keys 16 extending upwards from one side. The push end 20 extends from the neck 21 and is large enough to easily push with ones thumb or finger. Extensions 22 and 24 extend from one side of the keyed cylinder 18. Extension 24 has a return spring cavity 26 extending inwards as shown. Keys 28 extend downward as shown.

Referring to FIGS. 4. and 5. End thumb-wheel 30 and middle thumb-wheel 32 have extension 38 extending upwards and pin holes 36 extending through thumb-wheels 30 and 32 as shown. Key notches 34 extend into the extensions 38 as shown.

Figure 6:
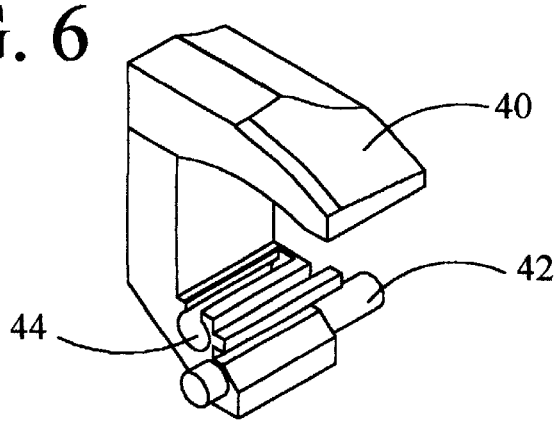
FIG. 6 is a perspective view of the trigger jam.
Figure 7:
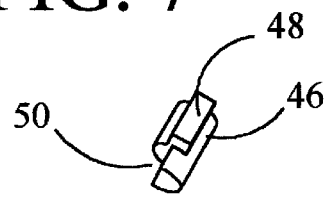
FIG. 7 is a perspective view of the lock pin.
Figure 8:
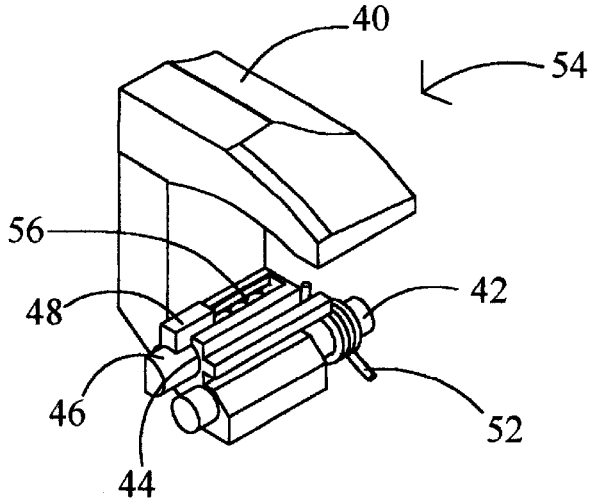
FIG. 8 is a perspective view of the trigger jam assembly.

Referring now to FIGS. 6, 7, and 8. Trigger jam 40 has a pivot shaft 42 and a slotted lock pin cavity 44 extending partially through one end of the trigger jam 40 as shown. Lock pin 46 has a key 48 extending upwards and a notch 50 located at one end as shown. Lock pin 46 fits snugly into the slotted lock pin cavity 44 as shown with the key 48 extending upwards through the slot of the slotted lock pin cavity and the notch 50 end of the lock pin 46 partially extending outwards from the trigger jam 40 as shown. Lock pin return spring 56 is positioned between lock pin 46 and the back of lock pin cavity 44, keeping one end of the lock pin normally extending outwards from the trigger jam 40 as shown. Trigger jam return spring 52 is positioned over one end of the pivot shaft 42. FIG. 8 illustrates the trigger jam assembly 54.

Figure 9:
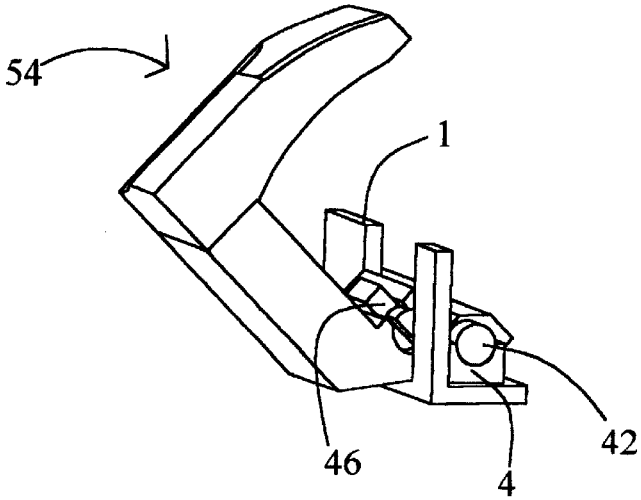
FIG. 9 is a perspective view of the trigger jam assembly in an unlocked position.

Referring to FIG. 9. The trigger jam assembly 54 in an unlocked position is shown with a partial view of the housing 1. The pivot shaft 42 is engaged with trigger jam supports 4. The lock pin 46 is held inwards by an edge of the housing 1 as shown. This will, from this point forward, be referred to as the unlocked position.

Figure 10:
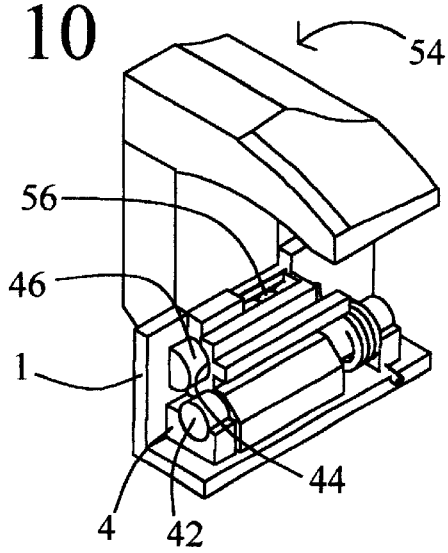
FIG. 10 is a perspective view of the trigger jam assembly in a locked position.

Referring now to FIG. 10. The trigger jam assembly 54 in a locked position is shown with a partial view of the housing 1. The pivot shaft 42 is engaged with trigger jam supports 4. The lock pin return spring 56 has pushed the lock pin 46 forward so the notch 50(FIG. 7) is engaging the edge of housing 1 as shown. The trigger jam assembly 54 is prevented from returning to the unlocked position because the housing 1 blocks that portion of the lock pin 46 extending from the lock pin cavity 44 from moving in the direction to become unlocked. This will from this point forward be referred to as the locked position.

Figure 11:
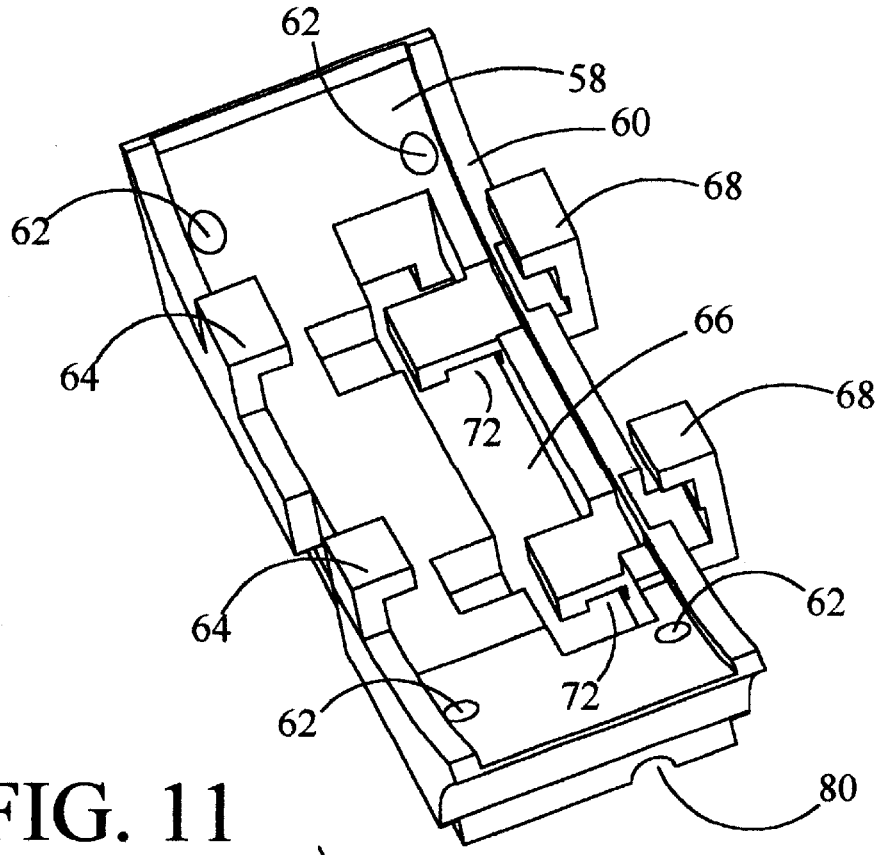
FIG. 11 is a perspective view of the adapter.

Referring to FIG. 11. The adapter 58 Has ridges 60 extending upwards from either side. Attachment means 62 extend through the adapter 58. Fixed clamps 64 extend upwards from one side of the adapter 58 and movable clamps 68 having key notches 72 extend through openings one the other side of the adapter 58 as shown. Notch 80 is positioned on one side as shown and extends through the base of the adapter 58. Slot 66 extends through the base of the adapter 58.

Figure 5:
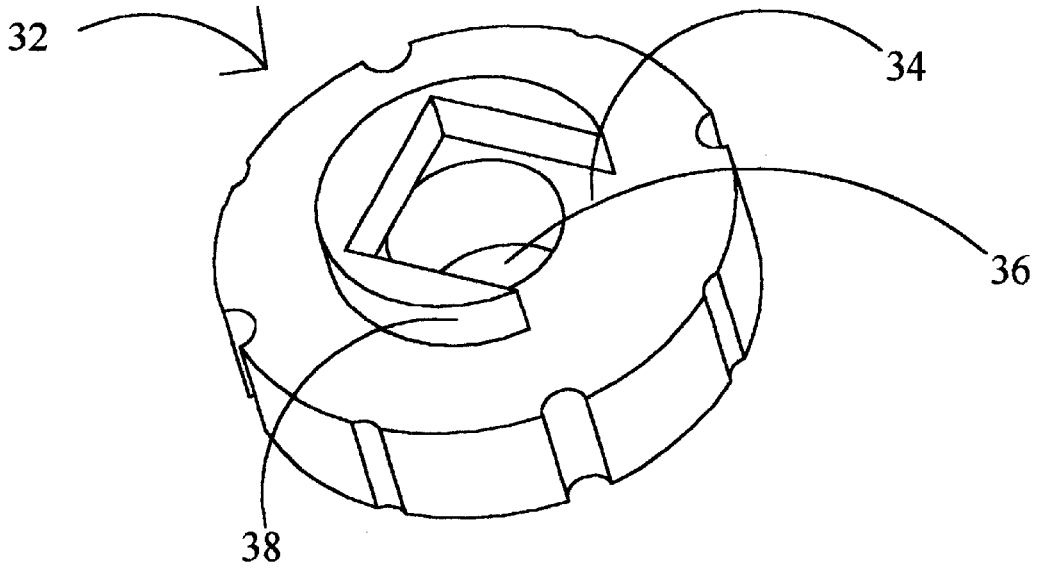
FIG. 5 is a perspective view of the middle thumb-wheel.
Figure 12:
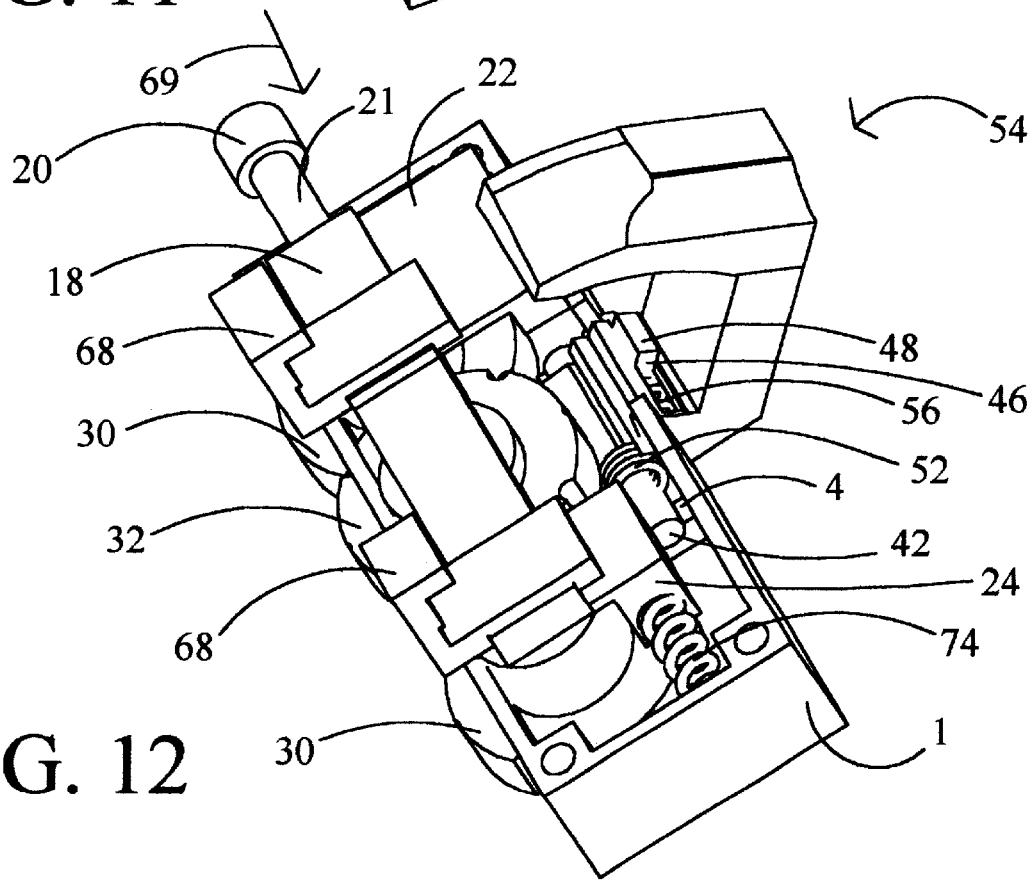
FIG. 12 is a perspective view of a partial assembly of the trigger lock.

Referring to FIG. 12. A partial assembly of the User Friendly Gunlock in an unlocked position is shown. From this point forward, the term forward will refer to the direction indicated by arrow 69 and the term rearward will refer to the opposite direction to that indicated by arrow 69. End thumb-wheels 30 and middle thumb-wheel 32 extend through thumb-wheel windows(FIG. 1). The keyed cylinder 18 is positioned over the extensions 38(FIGS. 4 and 5) of thumb-wheels 30 and 32 so keys 28(FIG. 3) are adjacent to extensions 38(FIGS. 4 and 5) of the thumb-wheels 30 and 32. When thumb-wheels 30 and 32 are turned so the open faces of the keyed notches 34(FIGS. 4 and 5) are faced rearward, the keys 28(FIG. 3) of the keyed cylinder 18 can engage the key notches 34(FIGS. 4 and 5), allowing the keyed cylinder to move forward. This will from this point forward be referred to as the correct combination. The push end 20 extends outside the housing 1 with the neck 21 fitted into notch 8(FIG. 1) of the housing 1. The movable clamps 68 are positioned over the keyed cylinder 18 so the key notches 72(FIG. 11) are adjacent to keys 16(FIG. 2). The trigger jam assembly 54 is received through the trigger jam window 2(FIG. 1) so the pivot shaft 42 engages the trigger jam supports 4. The keyed cylinder return spring 74 extends from return spring cavity 26(FIG. 2) at one end and is in contact with the housing 1 at the other end. Whenever the correct combination is entered and pressure is applied to push end 20 in a forward direction and then released, the keyed cylinder return spring 74 will push the keyed cylinder 18 back to the position shown here.

Still referring to FIG. 12, when the trigger jam assembly 54 is rotated upwards, the lock pin 46 locks the trigger jam assembly in the locked position as previously described in FIG. 10. When the correct combination has been entered and forward pressure is applied to push end 20, the keyed cylinder moves forward and the front face of extension 22 pushes on key 48 of lock pin 46, forcing lock pin 46 forward allowing trigger jam return spring 52 to return the trigger jam assembly 54 to the unlocked position. When forward pressure is removed, the keyed cylinder return spring 74 returns the keyed cylinder 18 back to the position shown here. If forward pressure is applied again to push end 20 while the correct combination is still entered and the trigger jam assembly 54 is in the unlocked position, the keyed cylinder 18 is allowed to move forward enough so keys 16(FIG. 2) completely disengage key notches 72(FIG. 11), allowing the movable clamps to move outward. When forward pressure is removed, the keyed cylinder return spring 74 returns the keyed cylinder 18 back to the position shown in here.

Figure 13:
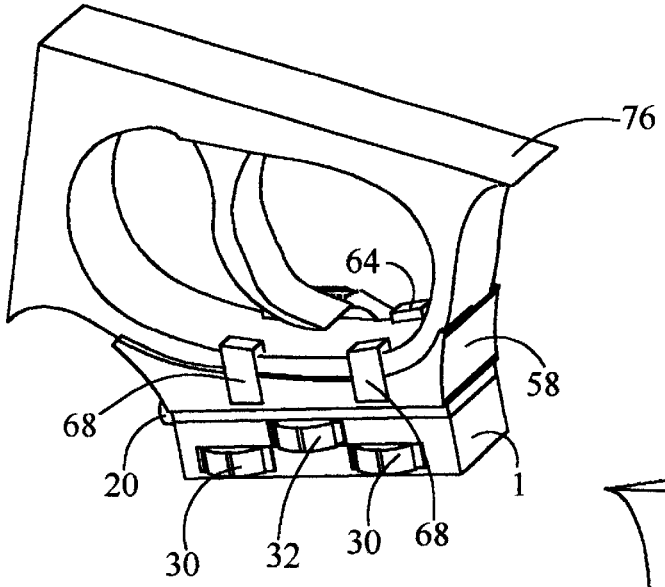
FIG. 13 is a perspective view of the trigger lock fastened to a trigger guard.
Figure 14:
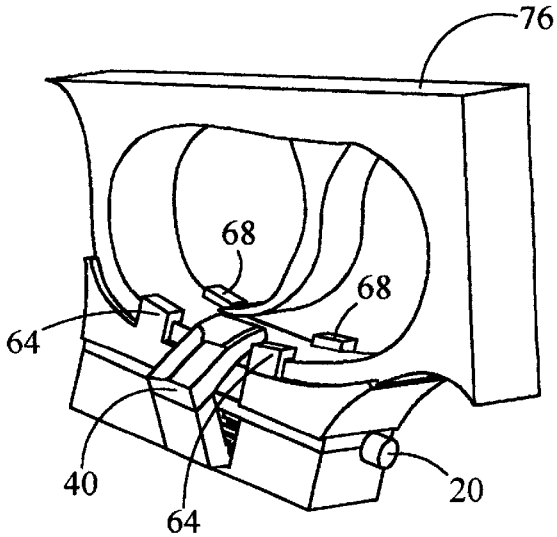
FIG. 14 is a perspective view of the trigger lock fastened to a trigger guard in an unlocked position.

Referring to FIGS. 13 and 14. Fasteners, preferably screws are used to fasten the adapter 58 to the housing 51 via attachment means 62(FIG. 11) and mounting means 6(FIG. 1). The adapter 58 is fastened to the trigger guard 76 with movable clamps 64 and fixed clamps 68. Thumb-wheels 30 and 32 extend through the housing 1 as shown. The trigger jam 40 is in the unlocked position and the correct combination has been entered. If forward pressure is applied to push end 20, keys 16(FIG. 2) will completely disengage key notches 72(FIG. 11) as previously described so that movable clamps 68 can move outwardly and disengage trigger guard 76, unfastening the adapter 58 from the trigger guard 76.

Figure 15:
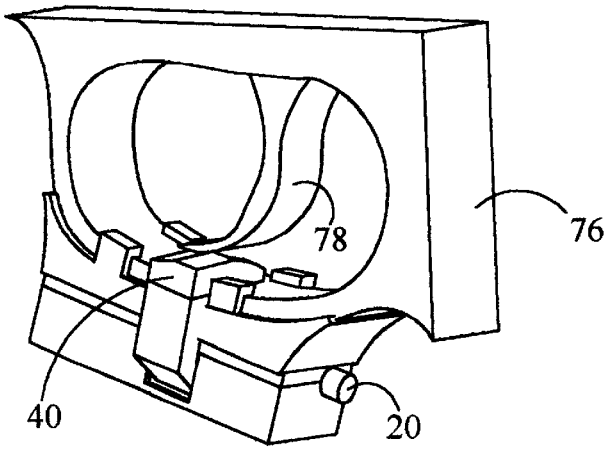
FIG. 15 is a perspective view of the trigger lock fastened to a trigger guard in a locked position.

Referring now to FIG. 15. The trigger jam 40 has been moved from below the trigger guard 76 in an unlocked position to the a position adjacent to the trigger 78 as shown in the locked position. In this position, the trigger jam 40 prevents movement of the trigger 78 from a forward position to a rearward position, preventing discharge of the firearm to which the trigger guard 76 belongs in a forward position as shown. The correct combination has been entered. If forward pressure is applied to push end 20, the trigger jam 40 will return to the unlocked position as previously described. Here it is important to note that the trigger jam 40 can be used to jam or lock the trigger 78 in both a forward position as shown here, or rearward position which will also prevent discharge or proper operation of a firearm.

Figure 16:
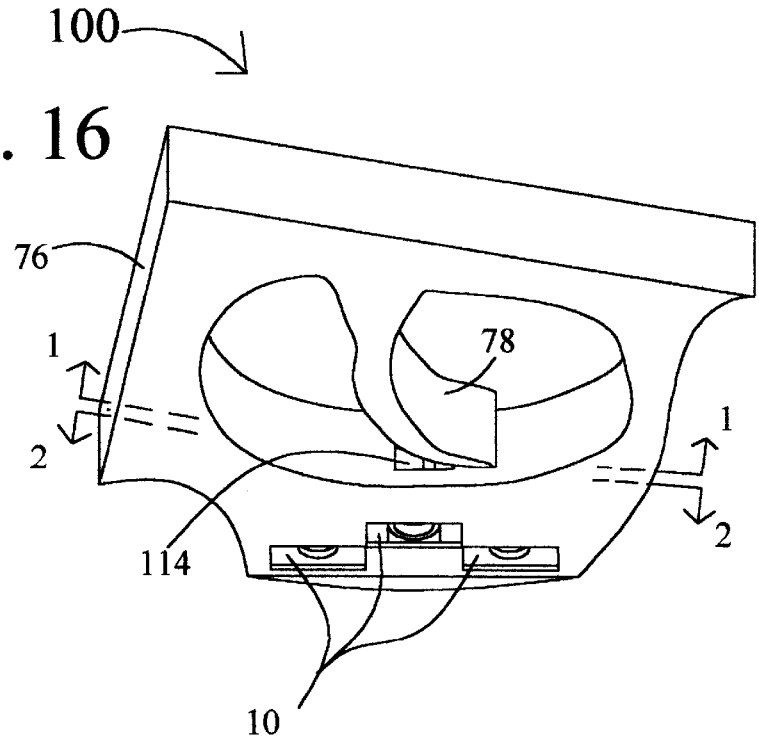
FIG. 16 is a perspective view of an alternative design where the housing is an integral part of the trigger guard.
Figure 17:
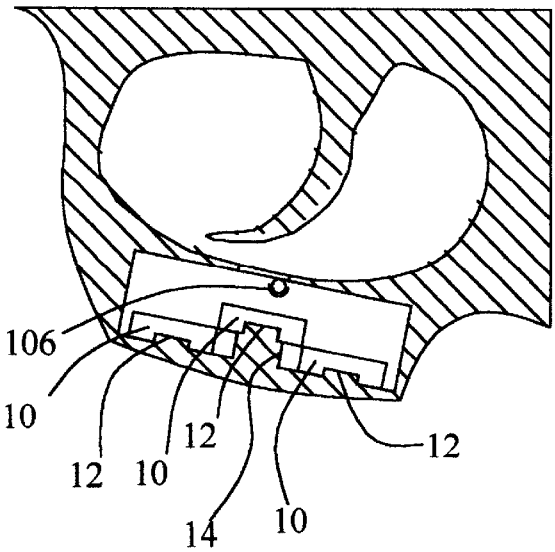
FIG. 17 is section view 2—2 from FIG. 15.
Figure 18:
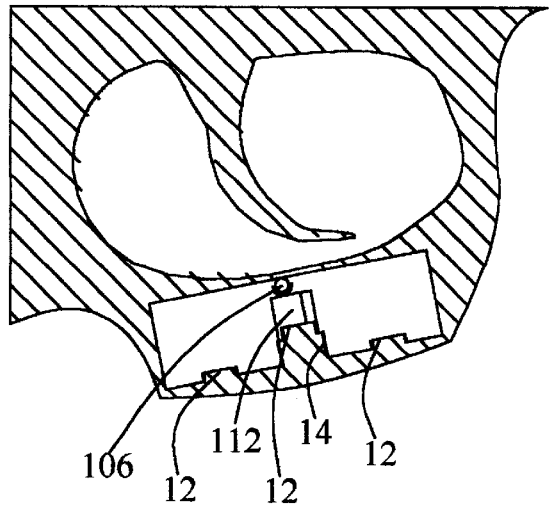
FIG. 18 is section view 1—1 from FIG. 15.

Referring now to FIGS. 16, 17, and 18 where FIG. 17 is section view 2-2 from FIG. 16 and FIG. 18 is section 1-1 from FIG. 16. Here the housing 100 is an integral part of the trigger guard 76. A trigger jam window 114 is positioned beneath the trigger 78 as shown. Thumb-wheel windows 10 extend through one side of the housing 100 as shown. Thumb-wheel pins 12 extend upwards from the base. Pedestal 14 elevates one thumb-wheel pin 12 higher than the other thumb wheel pins 12 as shown. Trigger jam supports 106 extend inward from both sides of the housing 100 as shown. Tapered extension 112 extends inwards from one side of the housing 100 as shown.

Figure 19:
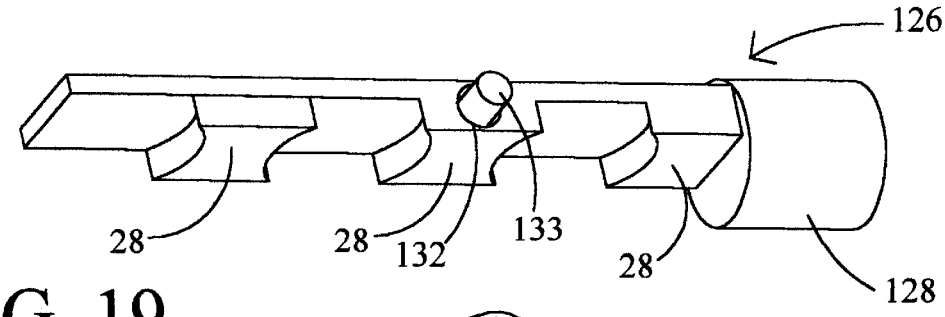
FIG. 19 is a perspective view of the release cylinder of the alternative design.

Referring to FIG. 19. Release cylinder 126 has a push end 128 extending from one end and keys 28 extending downwards as shown. Lock pin receiving hole 132 extends into but not all the way through release cylinder 126. Lock pin return spring(not shown) is inserted into lock pin receiving hole 132 and lock pin 133 is then inserted into lock pin receiving hole 132. The return spring(not shown) tends to keep the lock pin 133 extending outward from the lock pin receiving hole 132 as shown.

Figure 20:
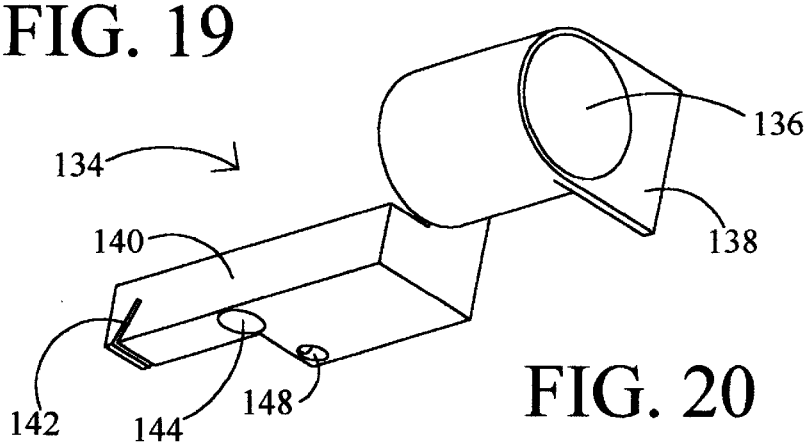
FIG. 20 is a perspective view of the lock cylinder of the alternative design.
Figure 21:
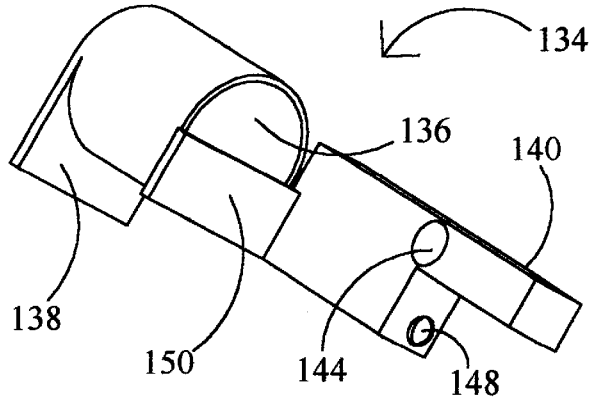
FIG. 21 is another perspective view of the lock cylinder of the alternative design.

Referring now to FIGS. 20 and 21. Lock cylinder 134 has a hollow push end 136 with a push plate 138 extending downwards as shown. Extension 140 extends from the hollow push end 136. Slot 142 is positioned as shown and lock pin lock hole 144 extends from one side of extension 140 to the other side of extension 140. Return spring notch 148 is positioned as shown. Partial block 150 extends across a portion of hollow push end 136 as shown.

Figure 22:
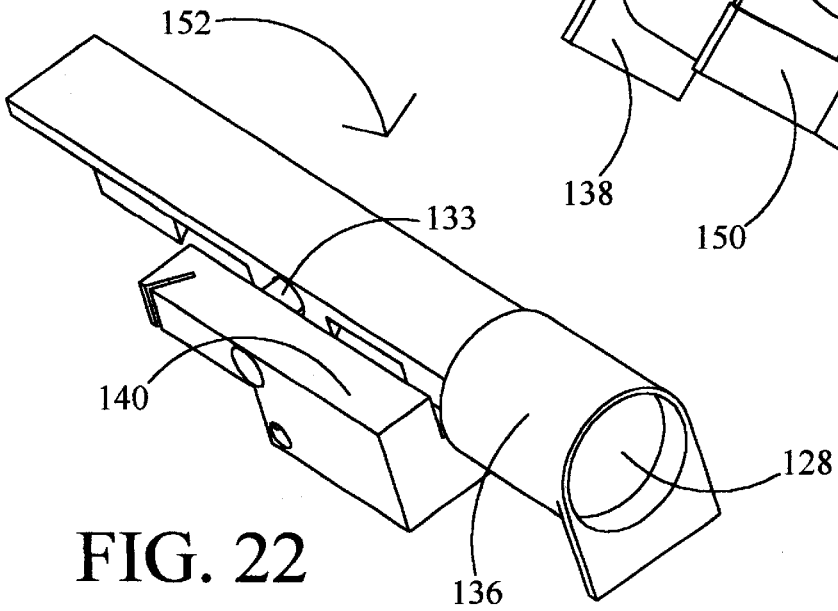
FIG. 22 is a perspective view of the cylinder assembly of the alternative design.

Referring now to FIG. 22. Cylinder assembly 152 consists of the forward end of release cylinder 126(FIG. 19) being inserted through the hollow push end 136 until the forward end of push end 128 encounters the partial block 150 as shown. Extension 140 applies inward pressure to lock pin 133 so that lock pin return spring(not shown) is applying outward pressure on lock pin 133.

Figure 23:
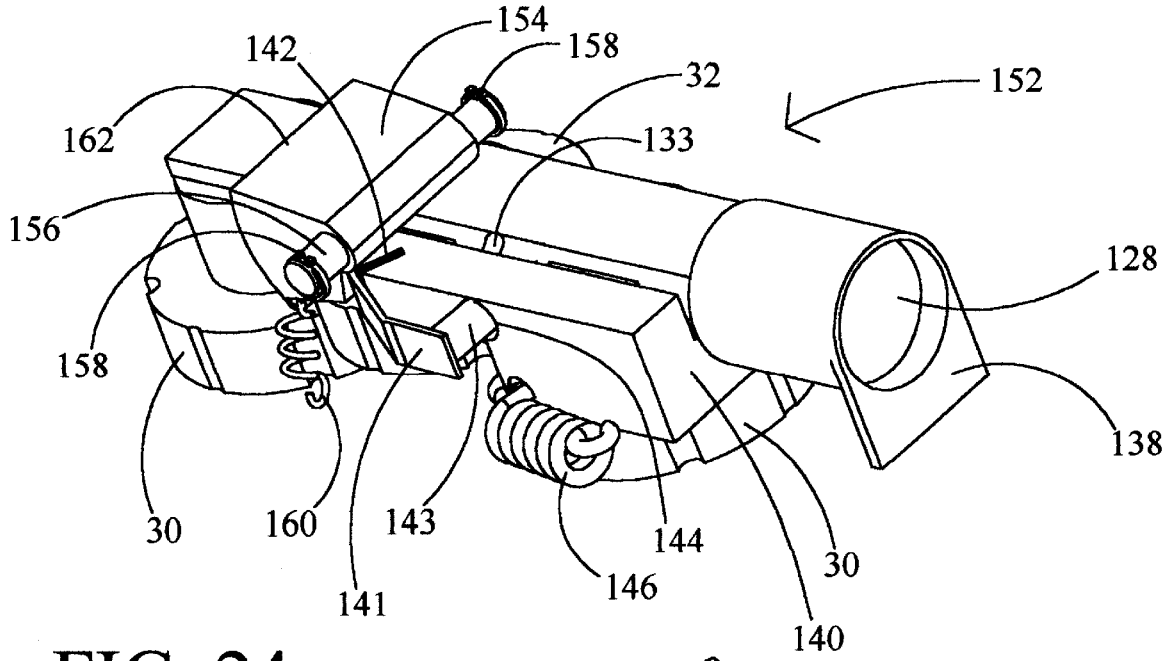
FIG. 23 is a perspective view of a partial assembly of the alternative design.
Figure 24:
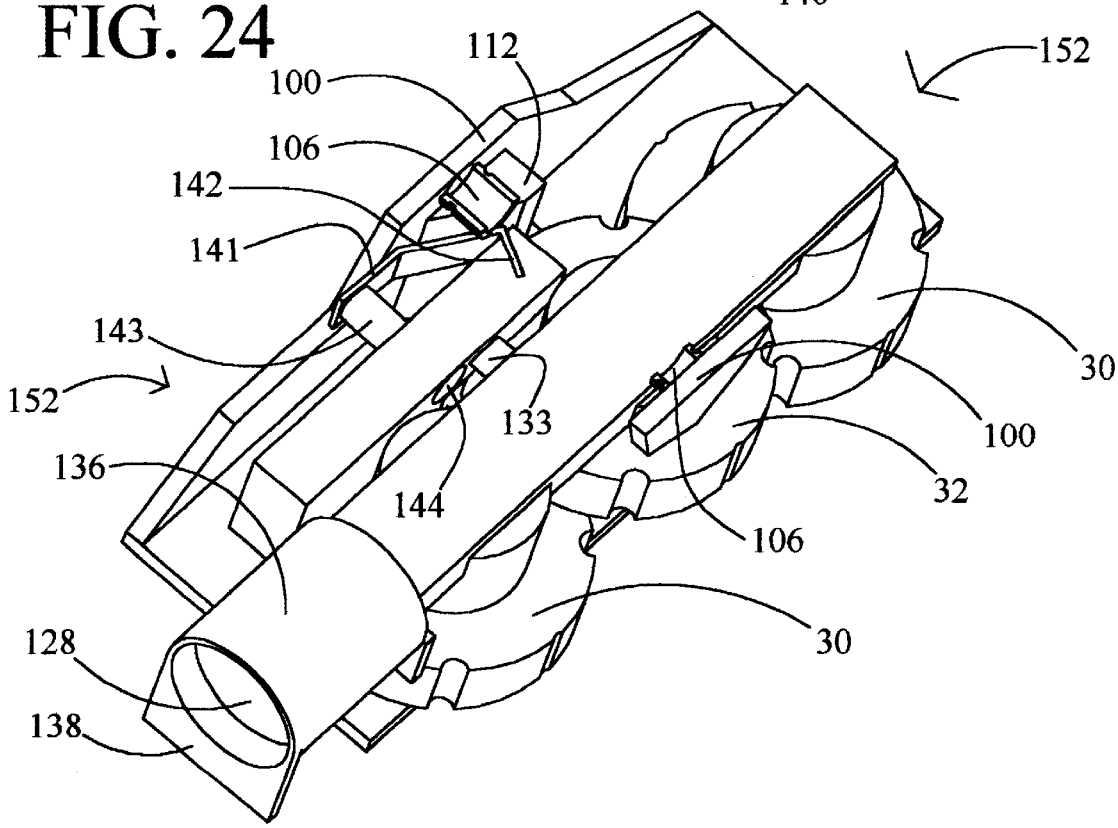
FIG. 24 is another perspective view of the of a partial assembly of the alterative design.

Referring now to FIGS. 23 and 24. Cylinder assembly 152 is positioned over the thumb-wheels 30 and 32 so keys 28(FIG. 19) are adjacent to extensions 38(FIGS. 4 and 5) of the thumb-wheels 30 and 32. When thumb-wheels 30 and 32 are turned so the open faces of the keyed notches 34(FIGS. 4 and 5) are faced rearward, the keys 28(FIG. 19) of the release cylinder 126 can engage the key notches 34(FIGS. 4 and 5), allowing the cylinder assembly 152 to move forward. This will again from this point forward be referred to as the correct combination. The positions shown are in the unlocked position. Clips 158 are used to fasten the trigger jam 154 via trigger jam shaft 156 to trigger jam supports 106 extending from the partial view of the housing 100. When forward pressure is applied to push plate 138, the forward end of extension 140 pushes on trigger jam 154 causing trigger jam 154 to rotate about trigger jam shaft 156 so the forward end 162 of trigger jam 154 moves in an upward direction through the trigger jam window 114(FIG. 16). When lock pin hole 144 lines up with lock pin 133, lock pin return spring(not shown) forces lock pin 133 into lock pin hole 144, locking lock cylinder 134(FIGS. 20 and 21) forward and the forward end 162 of trigger jam 154 upwards. This will from this point forward be referred to as the locked position. It is an important note here that in this locked position, the push end 128 will extend out of the hollow push end 136 beyond push plate 138.

One end of lock pin return spring 141 is inserted into slot 142. Push pin 143 extends from the other end of lock pin return spring 141. Push pin 143 is inserted into one side of lock pin lock hole 144 as shown.

When the correct combination is entered, and pressure is applied to push end 128, cylinder assembly 152 moves forward so that lock pin return spring 141 contacts tapered extension 112, forcing push pin 143 farther into lock pin lock hole 144 and pushing lock pin 133 out of lock pin lock hole 144, allowing lock cylinder return spring, that is connected at one end to extension 140 and connected at the other end to a portion of the housing 100 not shown, to move the lock cylinder 134 rearward, and allowing the trigger jam shaft return spring 160, that is connected to the trigger jam 154 at one end and connected to a portion of the housing 100 not shown at the other end, to return the trigger jam 154 to the unlocked position show in FIG. 23.

Figure 25:
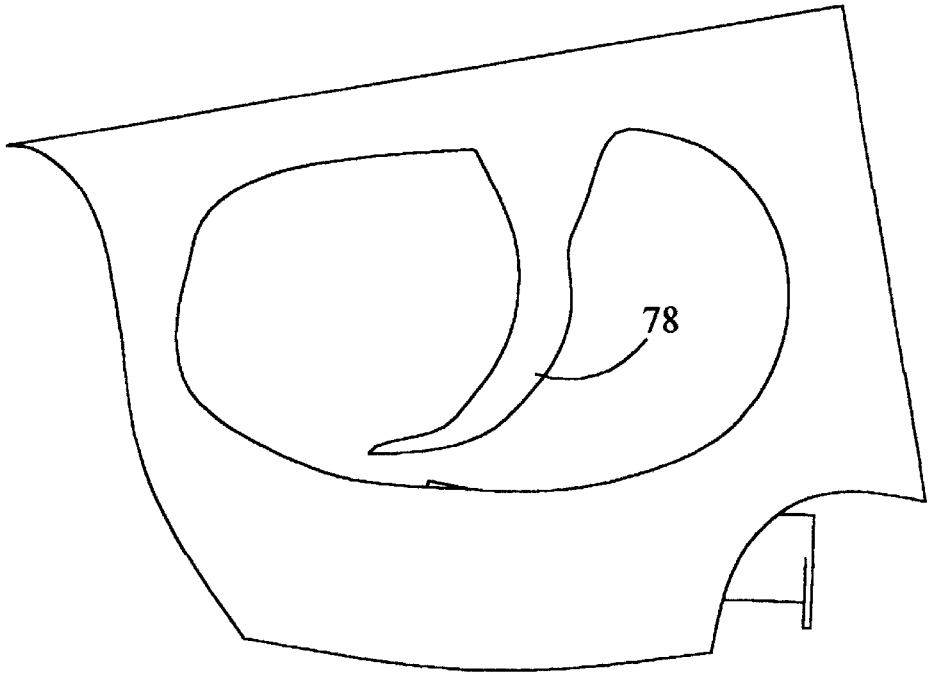
FIG. 25 is a perspective view of the alternative design in an unlocked position.
Figure 26:
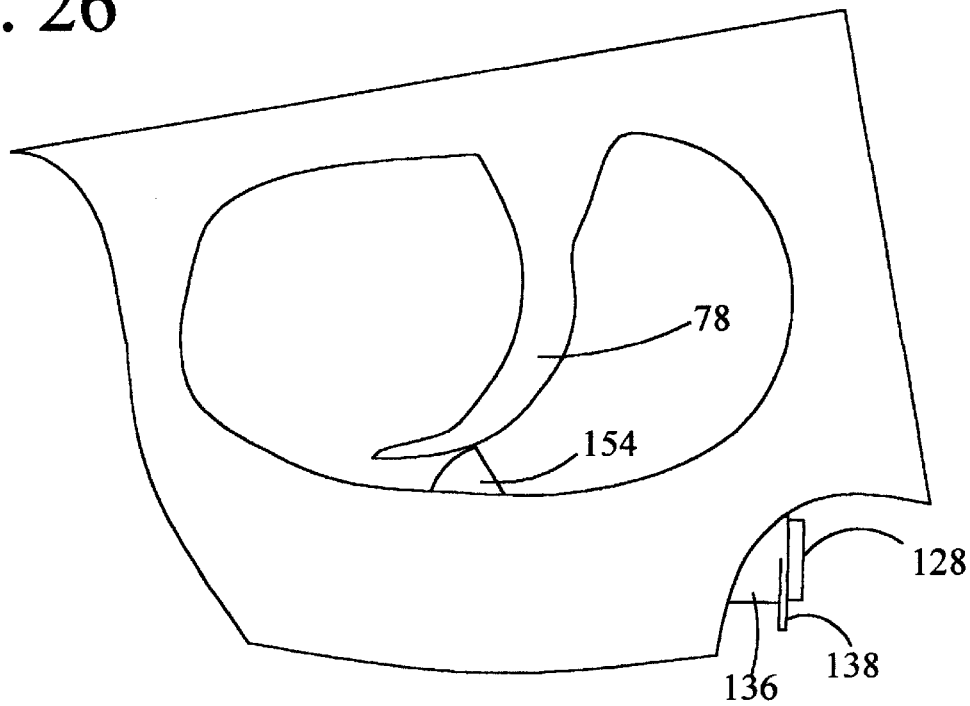
FIG. 26 is a perspective view of the alternative design in an locked position.

FIG. 25 shows the trigger 78 in an unlocked position. In FIG. 26 the push plate 138 has been pushed forward, locking the trigger jam 154 in an upward position, locking the trigger 78 in a forward position. In this locked position, push end 128 extends outwards from the hollow push end 136 as shown. When the correct combination is entered and forward pressure is applied to push end 128, trigger jam 154 will come to rest in the unlocked position as shown in FIG. 25. Here it is an important note that the trigger jam 154 can be used to lock the trigger 78 in a forward or rearward position as previously described.

I claim:

1. A gun lock comprising:

a housing dimensioned and configured to releasibly engage a trigger guard of a gun, the housing having a trigger jam window, at least one thumb wheel window, and at least one notch defined therein;

a keyed cylinder slidingly disposed within the housing and translatable between a first unlocked position and a second locked position, the keyed cylinder comprising:

a push end that extends outward from the notch in the housing;

at least one key extending from the keyed cylinder; and at least one extension extending from the keyed cylinder;

at least one thumb wheel pin disposed within the housing at a point proximate to the thumb wheel window;

at least one thumb wheel having a peripheral edge and a key notch defined therein, wherein the thumb wheel is rotatingly disposed on the thumb wheel pin such that the peripheral edge of the thumb wheel extends through the thumb wheel window, and further wherein the key notch is dimensioned and configured to matingly engage the key of the keyed cylinder when the thumb wheel is rotated to a predetermined position, and;

a trigger jam support disposed within the housing at a point proximate to the trigger jam window;

a trigger jam assembly comprising:

a trigger jam having pivot shaft defined therein, werein the pivot shaft rotatingly engages the trigger jam support such that the trigger jam extends from the trigger jam window and is movable between a first unlocked position wherein the trigger jam is removed from a trigger of the gun, and a second locked position wherein the trigger jam is urged against the trigger of the gun; and wherein the trigger jam has a slotted lock pin cavity defined therein and further comprises a lock pin slidingly disposed within the lock pin cavity, the lock pin being movable between a first unlocked position in which the lock pin will pass freely through the trigger jam window, and a second locked position in which the lock pin abuts the housing at point within the housing and wherein when in the locked position the lock pin arrests movement of the trigger jam from the locked position;

wherein when the thumb wheel is rotated to the predetermined position, the key of the keyed cylinder is able to matingly engage the key notch of the thumb wheel such that the keyed cylinder can be translated from the locked position to the unlocked position by pushing or pulling on the push end of the keyed cylinder, and further wherein when the keyed cylinder is translated from the locked position to the unlocked position, the extension extending from the keyed cylinder is urged against the lock pin such that the lock pin is moved from the locked position to the unlocked position, thereby allowing the lock pin to pass through the trigger jam window and the trigger jam to rotate about the pivot shaft from the locked position to the unlocked position.

2. The gun lock of claim 1, further comprising:

three keys extending from the keyed cylinder;

wherein the housing has three thumb wheel windows defined therein;

three thumb wheel pins, each thumb wheel pin being disposed within the housing at a point proximate to one of the three thumb wheel windows; and three corresponding thumb wheels, each rotatingly disposed on one of the three thumb wheel pins, each of the three thumb wheels having defined therein a key notch dimensioned and configured to matingly engage one of the three keys of the keyed cylinder when all three of the thumb wheels are rotated to predetermined positions.

3. The gun lock of claim 1, further comprising a first spring disposed within the housing, the first spring having a first end and a second end, wherein the first end of the first spring abuts the extension extending from the keyed cylinder and the second end of the first spring abuts an inner wall of the housing, and wherein the first spring urges the keyed cylinder toward its locked position.

4. The gun lock of claim 1, further comprising a second spring disposed about the pivot shaft of the trigger jam, the second spring dimensioned and configured to urge the trigger jam toward its unlocked position.

5. The gun lock of claim 1, further comprising a third spring disposed in the slotted lock pin cavity of the trigger jam, the third spring having a first end and a second end, and wherein the first end of the third spring contacts the trigger jam at a point within the slotted lock pin cavity and the second end of the third spring contacts the lock pin, and wherein the third spring urges the lock pin toward its locked position.

6. The gun lock of claim 1, further comprising a tubular push plate circumferentially disposed about the push end of the keyed cylinder, the push plate dimensioned and configured such that the push end of the keyed cylinder extends from the tubular push plate when the keyed cylinder is in its locked position.

7. A gun lock comprising:

a housing in the shape of a trigger guard, the housing having a trigger jam window proximate to a trigger of the gun, at least one thumb wheel window, and at least one opening defined therein;

a release cylinder slidingly disposed within the housing and translatable between a first unlocked position and a second locked position, the release cylinder comprising:

a push end that extends outward from the opening in the housing;

at least one key extending from the release cylinder; and a movable lock pin extending from the release cylinder, the lock pin movable between a first unlocked position and a second locked position;

a lock cylinder comprising a tubular push end, a push plate extending from the tubular push end, and an extension extending from the tubular push end at an end opposite from the push plate, the tubular push end of the lock cylinder being circumferentially and slidingly disposed about the push end of the release cylinder;

at least one thumb wheel pin disposed within the housing at a point proximate to the thumb wheel window;

at least one thumb wheel having a peripheral edge and a key notch defined therein, wherein the thumb wheel is rotatingly disposed on the thumb wheel pin such that the peripheral edge of the thumb wheel extends through the thumb wheel window, and further wherein the key notch is dimensioned and configured to matingly engage the key of the release cylinder when the thumb wheel is rotated to a predetermined position, and;

a trigger jam assembly comprising:

a trigger jam having shaft defined therein, wherein the shaft rotatingly engages the housing such that the trigger jam is movable between a first unlocked position wherein the trigger jam is removed from a trigger of the gun, and a second locked position wherein the trigger jam extends from the trigger jam window and is urged against the trigger of the gun; and wherein when the thumb wheel is rotated to the predetermined position, the key of the release cylinder is able to matingly engage the key notch of the thumb wheel such that the release cylinder can be translated from the locked position to the unlocked position by pushing on the push end of the release cylinder, and further wherein when the release cylinder is translated from the locked position to the unlocked position, the extension extending from the lock cylinder is urged against the lock pin such that the lock pin is moved from its locked position to the unlocked position, thereby allowing the trigger jam to rotate about the shaft from its locked position to the unlocked position.

8. The gun lock of claim 7, wherein the extension of the lock cylinder has a slot defined therein, and the gun lock further comprises a lock pin return spring, the lock pin return spring having a first end disposed in the slot, and a second end abutting the lock pin and urging the lock pin toward its unlocked position.

9. The gun lock of claim 8, further comprising a trigger jam shaft return spring disposed about the shaft of the trigger jam, the trigger jam shaft return spring being dimensioned and configured to urge the trigger jam toward its unlocked position.

* * * * *